US006467380B1

(12) United States Patent
Azkona

(10) Patent No.: US 6,467,380 B1
(45) Date of Patent: Oct. 22, 2002

(54) SELF-ADJUSTING PLIERS

(75) Inventor: Manuel Azkona, Abadiano (ES)

(73) Assignee: Super-Ego Tools, S. A. (ES)

( * ) Notice: Subject to any disclaimer, the term of this patent is extended or adjusted under 35 U.S.C. 154(b) by 0 days.

(21) Appl. No.: 09/881,184

(22) Filed: Jun. 14, 2001

(30) Foreign Application Priority Data

Mar. 30, 2001 (ES) ..... 200100759

(51) Int. Cl.[7] ..... B25B 7/04
(52) U.S. Cl. ..... 81/413; 81/357; 81/385
(58) Field of Search ..... 81/411, 412, 405, 81/407, 413, 357, 358, 341, 385

(56) References Cited

U.S. PATENT DOCUMENTS 4,269,089 A * 5/1981 Hastings ..... 81/409.5
4,893,530 A * 1/1990 Warheit ..... 81/409.5
5,351,584 A * 10/1994 Warheit ..... 81/407
6,000,303 A * 12/1999 Chang ..... 81/341
6,014,917 A * 1/2000 Bally et al. ..... 81/355
6,101,908 A * 8/2000 Azkona ..... 81/385
6,199,459 B1 * 3/2001 Azkona ..... 81/411

* cited by examiner

*Primary Examiner*—Joseph J. Hail, III
*Assistant Examiner*—David B. Thomas
(74) *Attorney, Agent, or Firm*—Bierman, Muserlian and Lucas

(57) ABSTRACT

The self-adjusting pliers have a male handle (6) and a female handle (11) with toothed jaws (10), (13), capable of sliding by means of a slip-joint or crimping pawl (14) that crimps them and slides in a window (8) with teeth (9), which is attached to one of the toothed jaws. Both handles (6), (11) are joined together by means of a rod (15) and an opening/closing spring (5) which joins the rod (15) to one of the handles (11). It has an additional spring (m) which is antagonistic to the opening/closing spring (5), attached to the crimping pawl (14) and lying against the surface (31) of the window (8) opposite the teeth (9) of this window (8).

1 Claim, 2 Drawing Sheets

SELF-ADJUSTING PLIERS

The self-adjusting pliers referred to are those described in U.S. Pat. No. 6,101,908 held by the applicant.

With manual pliers, the user has to move the jaws of the pliers into position by hand to find the most suitable grip.

DETAILED DESCRIPTION OF THE INVENTION

With self-adjusting pliers, the user assumes that the pliers themselves will find the most suitable clamping position. It therefore causes great inconvenience if the user has to check to see whether the pliers are holding the workpiece properly. Take the case of a pipe, for instance, where the position selected by the pliers is not appropriate and the user has to re-adjust them for himself by trial and error or guesswork.

SUMMARY OF THE INVENTION

The applicant has detected the problem and his diagnosis is that it lies in the crimping pawl, which takes up the wrong crimping position. The applicant has observed that the length of the path of the pawl is excessive from the point when the jaws of the pliers touch the workpiece until the teeth crimp together and the workpiece is finally gripped or held in place. This is what causes the problems mentioned above concerning the process of holding, gripping and clamping the workpiece.

The applicant has resolved the problem with an additional spring which helps the crimping pawl to turn quickly from the aforementioned moment of contact between the jaws of the pliers and the workpiece. As a result, the length of the path of the pawl is reduced.

So as to have a better understanding of the object of this invention, plans are provided showing the best way to use the tool, susceptible to accessory changes that do not involve any fundamental modifications.

Figure 1:
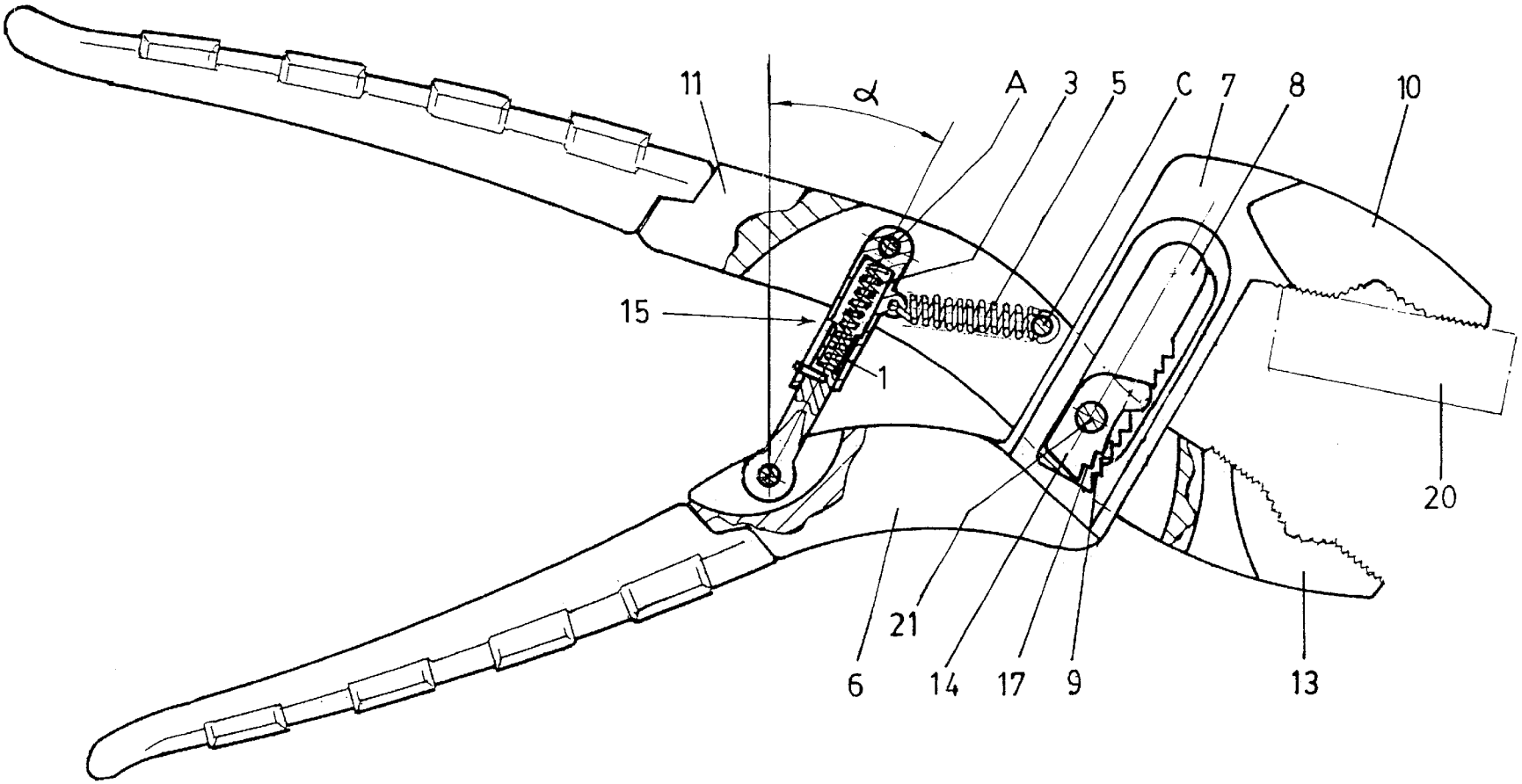
FIG. 1 is a detailed plan view showing the practical use of a known pair of pliers with a known crimping pawl (14).

A description now follows of an example of the non-restrictive practical use of this invention.

The pliers, as known, have a male handle (6) with a head (7) and upper toothed jaw (10) in which a window (8) has been made with teeth (9) and a female handle (11) with a large opening (12) allowing for the passage of the head (7) of the male handle (6), and holding (housing) the lower toothed jaw (13) and the toothed crimping pawl (14) which pivots and engages the teeth (9) of the window (8).

The male (6) and female (11) handles are joined by a rod (15) that pivots at each end in the male and female handles (6), (11) and an internal spring (3).

In FIG. 1 there is an opening spring (5) attached to the outside casing (1) of the rod (15) and to the female handle (11) enabling it to pivot freely (C), with its pivoting axis (C) best being situated between the pin (A) on the outside casing (1) and the pivoting spindle (21) of the pawl (14).

The spring (5) tends to hold the male and female handles (6), (11) open.

The crimping pawl (14) has teeth (17) at the front, which should engage the teeth (9) of the head (7) of the male handle (6).

Figure 2:
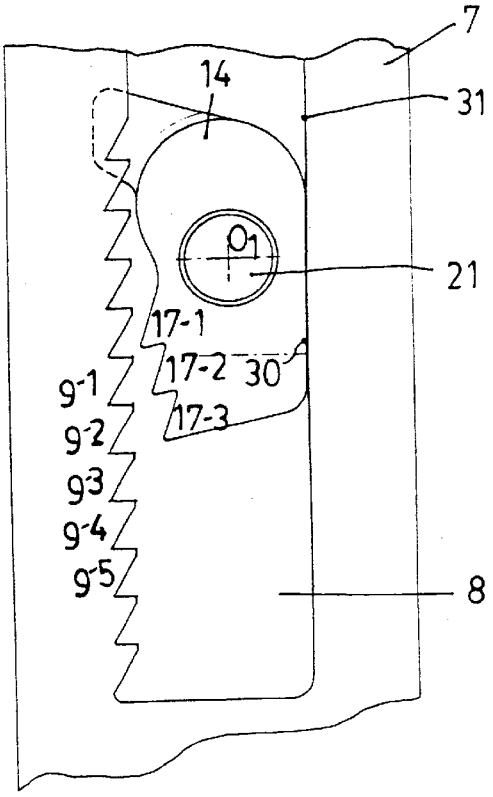
FIG. 2 is a view of the rest position prior to squeezing the male and female handles (6), (11) of the pliers by hand, using both the crimping pawl shown in FIG. 1 and the pawl of the invention.
Figure 3:
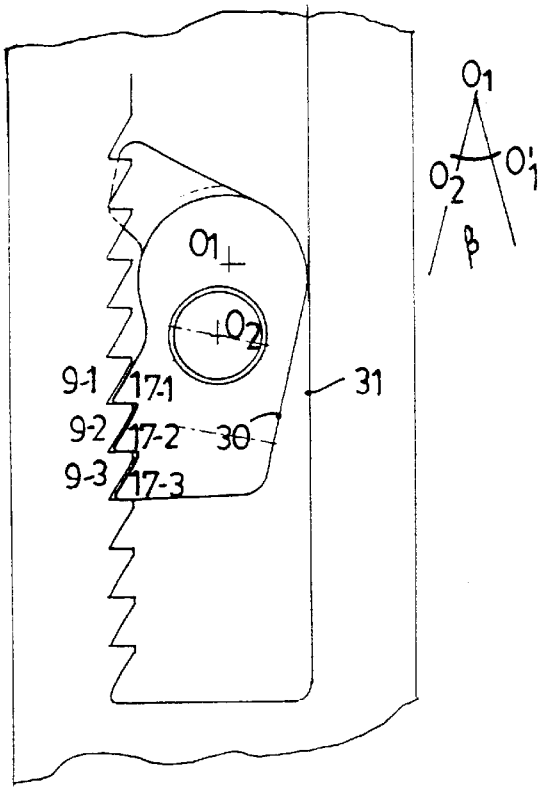
FIG. 3 is a view of the known pawl illustrated in FIGS. 1 and 2 in the crimping position with the jaws (10), (13) gripping the workpiece (20).

The spring (5) tends to bring the upper surface (30) of the crimping pawl (14) into contact with the surface (31) of the window (8) opposite the teeth (9) (FIGS. 2 and 3).

The jaws (10), (13) of the pliers should grip the workpiece (20) in such a way that the user only has to squeeze the male and female handles (6), (11) of the tool together. At the moment when the jaws (10), (13) make contact with the workpiece, the pliers should be in the position shown in FIG. 2.

Since the pliers are self-adjusting, the user need not consider the position of the crimping pawl (14) but merely needs to continue to grip the pliers, confident that their self-adjusting mechanism will work correctly.

In practice, (and this is the problem that needs solving), such confidence is let down and the jaws (10), (13) fail to hold and grip the workpiece (20) properly. Why is this so?

The jaws (10), (13) are now in contact with the workpiece (20), and should not separate. This is the position and moment in which they should begin to grip and hold the workpiece.

If we observe FIG. 2 (position to begin gripping) it is expected that the upper tooth (17-1) of the crimping pawl (14) will engage directly with the tooth (9-1) opposite the head (7).

After studying this phenomenon, the applicant has seen that this is not the case.

In practice (FIG. 3) the upper tooth (17-1) of the crimping pawl engages with tooth (9-2), that is to say, with the one immediately following tooth (9-1), which is required for everything to work properly.

The centre of rotation $(\mathbf{0}_1)$ of the spindle (21) of the crimping pawl (14) has shifted to $(\mathbf{0}_2)$ (FIG. 3) with a kinematic path with a clearly descending linear component $(\mathbf{0}_1, \mathbf{0'}_1)$ and a small rotation $\mathbf{0'}_1\ \mathbf{0}_2$ (β).

The linear component $\mathbf{0}_1, \mathbf{0'}_1$ is responsible for the teeth (17) of the crimping pawl (14) engaging the teeth (9) immediately following the appropriate ones opposite.

The cause lies in the fact that while the user is gripping the handles (6), (11), the springs (3), (5) of the self-adjusting mechanism tend to bring the rear surface (30) of the crimping pawl (14) into contact with the surface (31) of the window (8) opposite teeth (9) (FIGS. 2, 3), but as soon as the jaws (10), (13) make contact with the workpiece (20), the action of the springs (3), (5) weighs against the effort of the user, and the female handle unit (11) tends to turn or slide, shifting position with respect to the male handle (6), along with the crimping pawl (14) until the teeth (17) of the pawl (14) engage the teeth (9) of the head (7) of the male handle (6).

On analysis of the problem, it is seen that the small rotation (β) $\mathbf{0'}_1\ \mathbf{0}_2$ is always required for teeth (17) and (9) to engage and what is excessive is the linear component $\mathbf{0}_1$, $\mathbf{0'}_1$. Both movements take place simultaneously until crimping in one time $(t_1)$.

Figure 4:
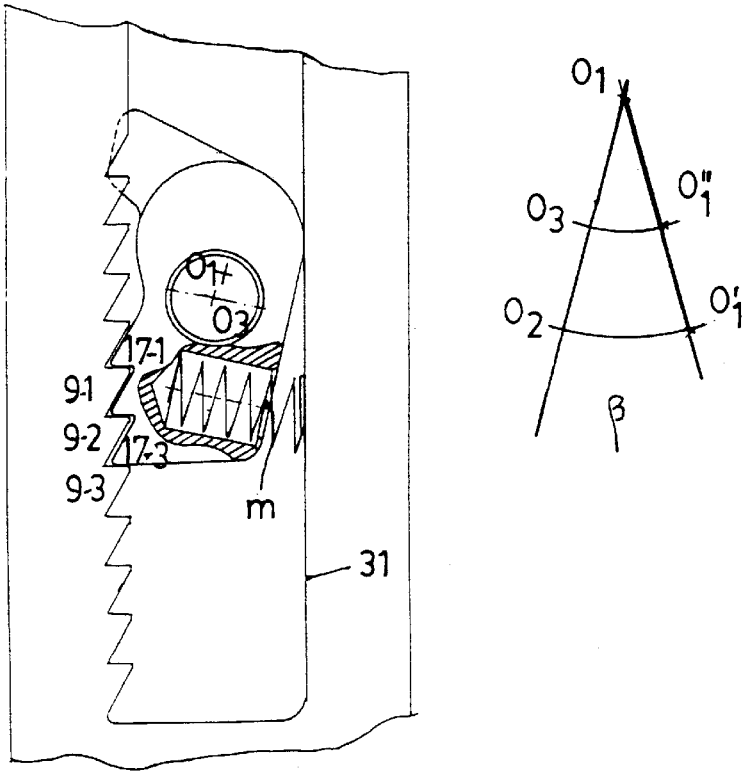
FIG. 4 is a view of the pawl of the invention in the crimping position.

The applicant has solved the problem, by reducing the crimping time $(t_2)$ so that it is much shorter than the time of the previous device $(t_1)$. For this to be so, the crimping pawl is provided with an additional spring (m), antagonistic to spring (5) linking the female handle (11) and the rod (15) (FIG. 4).

The action of this extra spring (m) is continuous, but not noticeable until the jaws (10), (13) come into contact with the workpiece (20) and the user's hand has overcome the action of the spring (5) which tends to place the crimping pawl (14) in the rest-non-engagement position. Once this moment has been reached, the additional spring (m) tends to make the pawl (14) rotate on its rotation centre ($\mathbf{0}_1$), which is added to the conventional action of the user who squeezes the handles (6), (11), in such a way that the following chain of cause and effect is set in motion: the small rotation (β) $\mathbf{0}''_1$ $\mathbf{0}_3$ is achieved very quickly, and consequently the linear component $\mathbf{0}_1$ $\mathbf{0}''_1$ is very small. As a result, crimping is fast and therefore the teeth (17-1), (17-2), (17-3) of the pawl (14) engage their corresponding teeth opposite (9-1), (9-2), (9-3), in the head (7).

The spring (m) is compressed preferably by a perforation of the pawl (14) at the rear, in a part that is as far removed as possible from the rotation centre ($\mathbf{0}_1$) and the action against the surface (31) of the window, opposite the teeth (9).

What is claimed is:

1. Self-adjusting pliers comprising: a male handle (6) and a female handle (11) with toothed jaws (10), (13), capable of sliding by means of a crimping pawl (14) that crimps them and slides in a window (8) with teeth (9), which is attached to one of the toothed jaws; said handles (6), (11) are joined together by means of a telescoping rod (15) having a first spring (3) therein and a second spring (5) which joins the rod (15) to one of the handles (11), a third spring (m) which is antagonistic to the second spring (5), attached to the crimping pawl (14) and lying against the surface (31) of the window (8) opposite the teeth (9) of this window (8).

* * * * *